US009802292B2

(12) United States Patent
Chung et al.

(10) Patent No.: US 9,802,292 B2
(45) Date of Patent: Oct. 31, 2017

(54) ADVANCED POLISHING SYSTEM

(71) Applicant: Taiwan Semiconductor Manufacturing Company, Ltd., Hsin-Chu (TW)

(72) Inventors: Che-Liang Chung, Taoyuan (TW); Shich-Chang Suen, Hsinchu (TW); Chun-Kai Tai, Taoyuan (TW); Wei-Chen Hsiao, Taipei (TW)

(73) Assignee: TAIWAN SEMICONDUCTOR MANUFACTURING CO., LTD., Hsin-Chu (TW)

( * ) Notice: Subject to any disclaimer, the term of this patent is extended or adjusted under 35 U.S.C. 154(b) by 70 days.

(21) Appl. No.: 15/048,590

(22) Filed: Feb. 19, 2016

(65) Prior Publication Data

US 2017/0239777 A1 Aug. 24, 2017

(51) Int. Cl.
*B24B 53/017* (2012.01)
*B24B 37/005* (2012.01)
*B24B 37/26* (2012.01)

(52) U.S. Cl.
CPC ..... *B24B 37/005* (2013.01); *B24B 37/26* (2013.01)

(58) Field of Classification Search
CPC ..... B24B 53/00; B24B 53/017
USPC ..... 451/5, 8–10, 41, 443–444, 6, 21
See application file for complete search history.

(56) References Cited

U.S. PATENT DOCUMENTS

| | | | | |
|---|---|---|---|---|
| 7,359,069 | B2 * | 4/2008 | Tanaka | B24B 37/26 356/630 |
| 8,221,193 | B2 * | 7/2012 | Chang | B24B 37/042 451/5 |
| 9,486,893 | B2 * | 11/2016 | Chen | B24B 53/017 451/56 |
| 2014/0273752 | A1 * | 9/2014 | Bajaj | B24B 53/017 451/6 |
| 2015/0273652 | A1 * | 10/2015 | Qian | B24B 37/013 438/692 |

* cited by examiner

*Primary Examiner* — Robert Rose
(74) *Attorney, Agent, or Firm* — Haynes and Boone, LLP

(57) ABSTRACT

A method for polishing a polishing pad includes detecting, by a first sensor, a presence of a defect formed on a groove of a polishing pad; removing, by a polishing disc, the defect from the groove of the polishing pad; after removing the defect, measuring, by a second sensor, a remaining depth of the groove; and based on the measured remaining depth of the groove, applying, through the polishing disc, a polishing condition on the groove.

20 Claims, 7 Drawing Sheets

ADVANCED POLISHING SYSTEM

BACKGROUND

During semiconductor fabrication a substrate may be polished or planarized to remove a layer or portion thereof from the substrate. One such process is known as chemical mechanical polishing (CMP). In a typical CMP process, a substrate is supported by an apparatus, which presses the substrate against a polishing pad (e.g., a rotating pad). Often the pad polishes the substrate in the presence of a polishing slurry, water, or other fluid. During the polishing, the properties of the polishing pad may be altered, for example, changing the polishing rate or quality (e.g., uniformity). Thus, pad conditioning is performed to restore the polishing pad by reconditioning the surface of the polishing pad that comes into contact with the substrate during polishing. Although existing polishing pads and methods of pad conditioning have been generally adequate for their intended purposes, they have not been entirely satisfactory in all respects.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
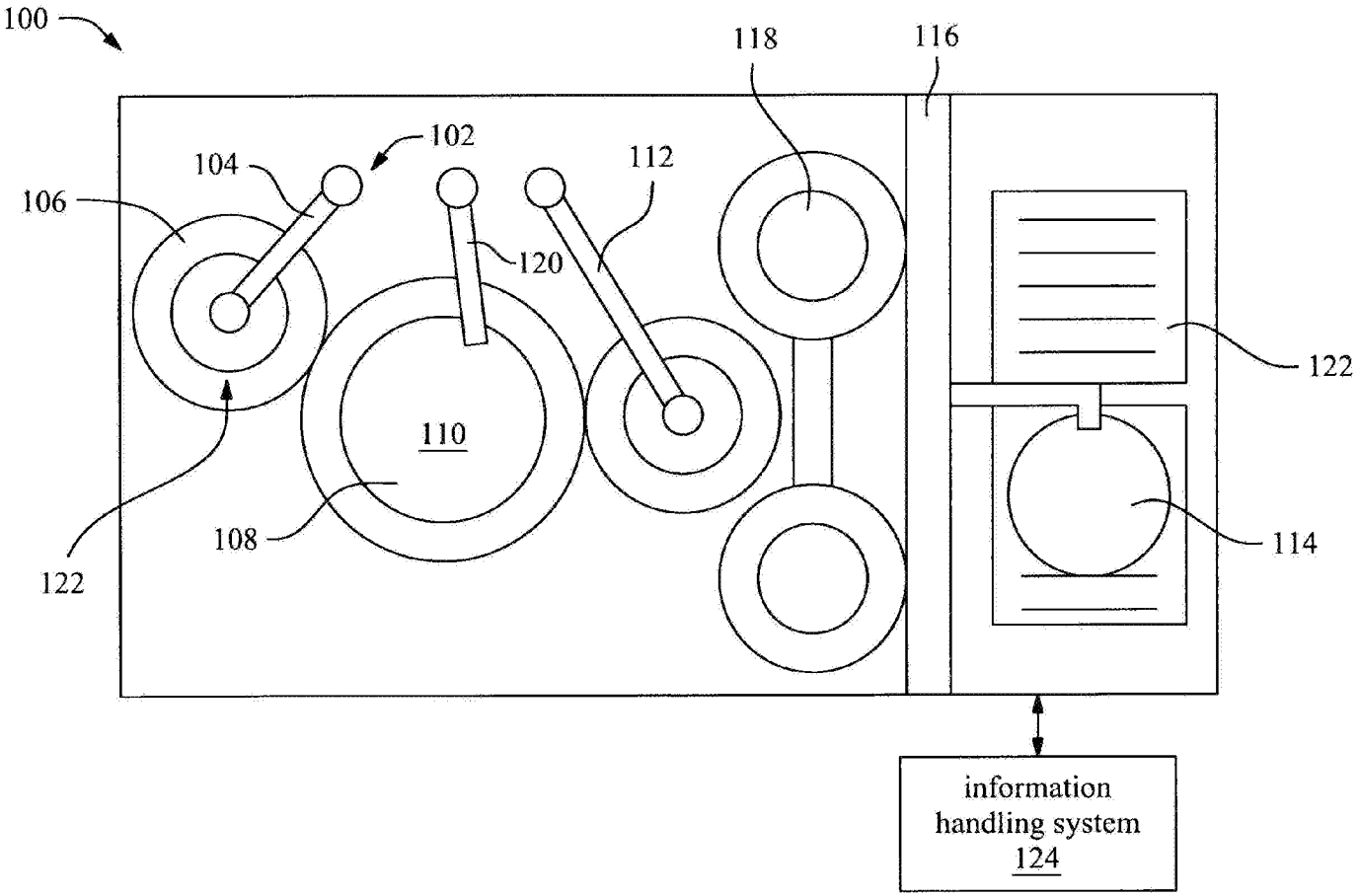
FIG. 1 is a schematic view of a chemical-mechanical polishing (CMP) tool, in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Illustrated in FIG. 1 is an embodiment of a chemical-mechanical polishing (CMP) apparatus apparatus/tool 100. In the illustrated embodiment of FIG. 1, the CMP tool 100 includes a rotating platen 108 having a polishing pad 110 disposed thereon. The CMP tool 100 further includes a fluid delivery arm/pipe 120 that is configured to provide a polishing slurry onto the polishing pad 110. In some embodiments, the fluid delivery arm 120 may be further configured to control a flow rate of the polishing slurry.

The CMP tool 100 also includes a conditioning device 102. Conditioned device 102 is operable to recondition a polishing pad, such as polishing pad 110. The conditioning device 102 includes a carrier arm 104 that is operable to move a polishing disc 106. The conditioning device 102 also includes a dresser head 122 that is operable to provide a rotation and/or apply a load to the polishing disc 106, which will be discussed in detail below. In accordance with various embodiments, the dresser head 122 may include one or more sensors that are configured to provide a variety of functions for maintaining the CMP tool 100, which will be discussed in detail below.

Referring still to FIG. 1, a wafer arm 112 is operable to hold a substrate 114 (e.g., semiconductor wafer) on the arm 112. In operation, substrate 114 is positioned (face down) on the rotating platen 108 (more specifically, the polishing pad 110) and a downward force of the substrate 114 against the polishing pad 110 is provided, thereby performing a polishing process on the substrate 114. In some embodiments, the CMP tool 100 further includes a handling system 116 which includes staged areas 118 for positioning of the substrate 114 before and after the polishing process and a (handling) device 122 for transferring the substrate 114 from its cassette to the tool. The CMP tool 100 includes various control systems including end point detection monitors, platen temperature controls, and control systems, and/or other systems known in the art. For example, the CMP tool may include or be coupled to an information handling system 124 that is configured to provide various control/maintain functions to the CMP tool 100, which will be described below.

In some embodiments, the polishing pad 110 includes a grooved surface, whereby the grooved surface is configured to face a to-be polished surface of the substrate 114. Such a grooved surface may advantageously provide a variety of functions such as, for example, preventing a hydroplaning effect between the polishing pad and the substrate, acting as drain channels for removing polishing debris, and ensuring applied slurry to be uniformly distributed across the polishing pad, etc. Generally, the grooved surface of the polishing pad includes a plurality of grooves, and each of the plurality of the grooves has a depth which will be illustrated and described with respect to FIG. 2*b* in more detail below.

One factor determining lifetime of a grooved polishing pad is the depth of the grooves, as acceptable polishing performance is possible only until the polishing pad has been worn to the point where grooves have insufficient depth to distribute slurry, remove waste, and prevents hydroplaning. In order to achieve a long lifetime of a polishing pad, it is necessary to have deep grooves or, at least, sustainable grooves. It is not uncommon to have polishing debris formed on the grooves during or after a polishing process. Such debris may be formed due to a variety of reasons such as, for example, debris that is polished out from a substrate and not drained through the grooves. The debris is generally considered as a defect to the polishing pad since the debris may block the grooves and in turn cause a stiffness issue of the polishing pad. Conventionally, such debris (defect) is removed offline and manually, which means that the debris is usually detected by a user/administrator of the polishing pad after one or more polishing processes and then a conditioning device (e.g., a polishing disc) may be used to remove the debris though the user/administrator applying a downward force. The downward force is commonly overestimated to ensure the debris is removed from the groove, which in causes an over-polished groove (i.e., shallower depth). As such, the lifetime of the polishing pad is disadvantageously reduced. The present disclosure provides various embodiments of systems and methods to avoid the above-identified issue by providing an in-situ (during polishing) monitoring and measuring of a polishing pad. The in-situ monitoring and the measuring may be implemented through one or more sensors coupled to a dresser head, which will be described in the following discussion.

Figure 2A:
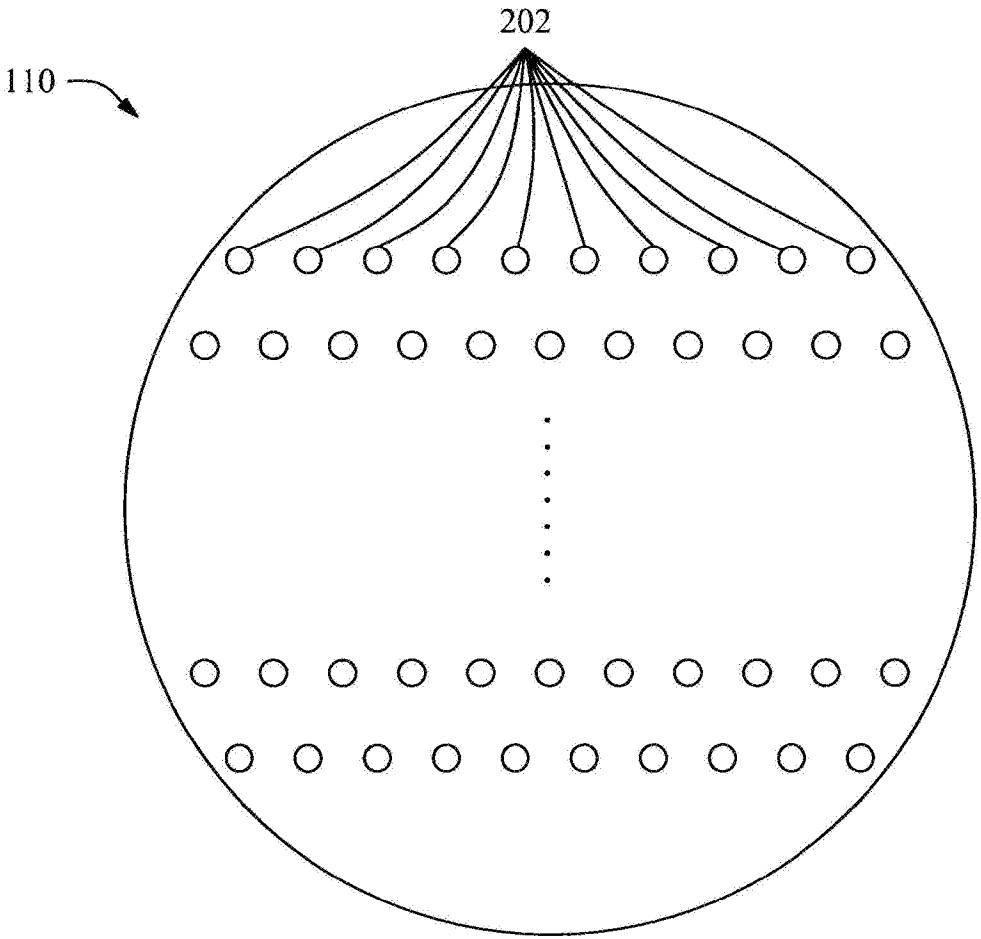
FIG. 2*a* is a top view of a polishing pad in the CMP tool of FIG. 1, in accordance with some embodiments.
Figure 2B:
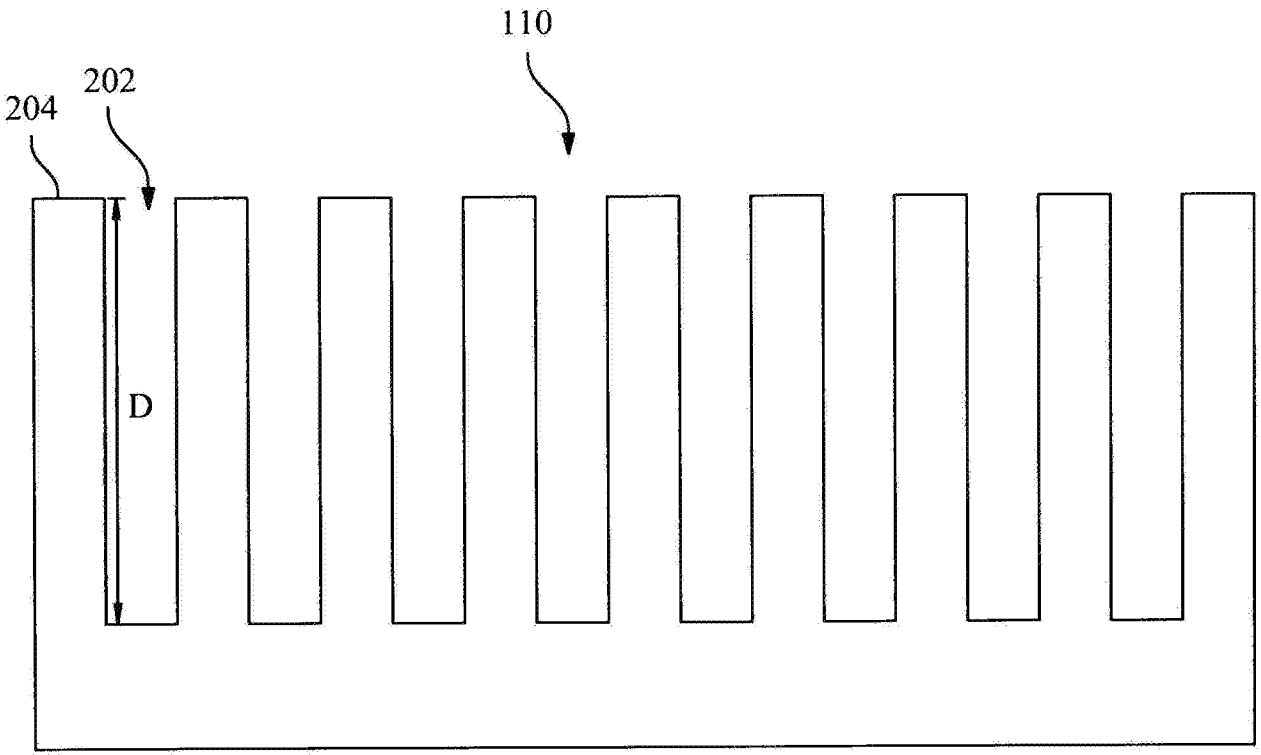
FIG. 2*b* is a cross-sectional view of a polishing pad in the CMP tool of FIG. 1, in accordance with some embodiments.
Figure 2C:
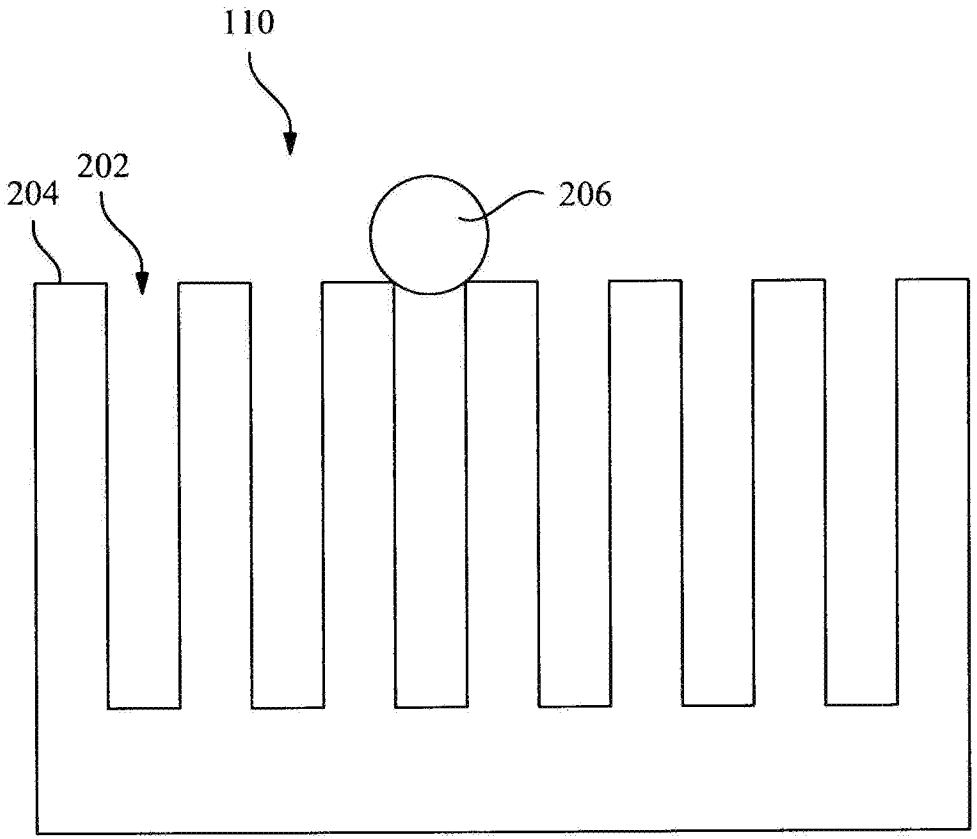
FIG. 2*c* is a cross-sectional view of an example in which debris is formed on the polishing pad in the CMP tool of FIG. 1, in accordance with some embodiments.
Figure 2D:
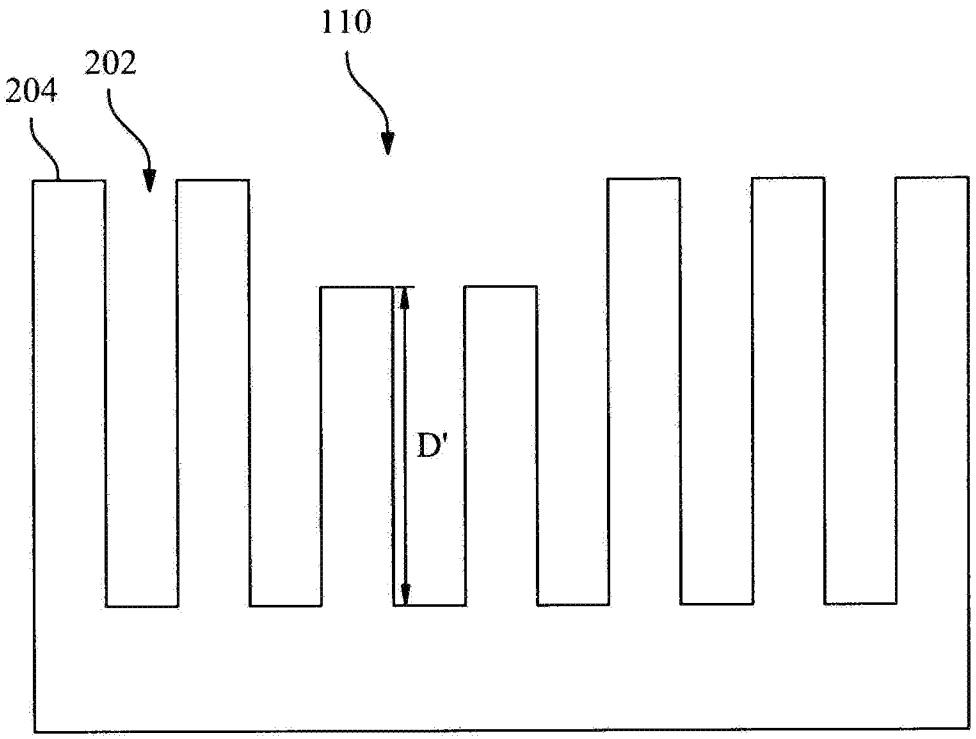
FIG. 2*d* is a cross-sectional view of an example in which the debris formed on the polishing pad in the CMP tool of FIG. 1 is removed, in accordance with some embodiments.

Referring now to FIGS. 2*a* and 2*b*, a top view and a cross-sectional view of the polishing pad 110 is respectively illustrated. In FIG. 2*a*, the polishing pad 110 includes a plurality of grooves 202. In the illustrated embodiment of FIG. 2*a*, the plurality of grooves may be formed in a particular pattern. However, while remaining within the scope of the present disclosure, the grooves may be formed randomly as long as the grooves are able to provide the desired functions. In FIG. 2*b*, the polishing pad 110 has a top surface 204 that includes the plurality of the grooves 202. More specifically, each of the grooves has a depth "D" that ranges from about 250 micrometers to about 5,100 micrometers. FIG. 2C illustrates an example of a debris 206 is formed on one of the grooves 202. As illustrated, the debris 206 may block an applied slurry from going into the blocked groove and may disadvantageously cause at least one of the above-identified issues. FIG. 2D illustrates an example of the debris 206 being removed by conventional approaches. As described above, the debris 206 is usually removed manually by applying an overestimated downward force on the polishing pad. Thus, after the debris being removed, the blocked groove(s) may have a depth D' that is shallower than its original depth D. Such over-polished grooves may disadvantageously cause a variety of issues such as, for example, reduced lifetime of the polishing pad, stiffness of the polishing pad, etc.

Figure 3:
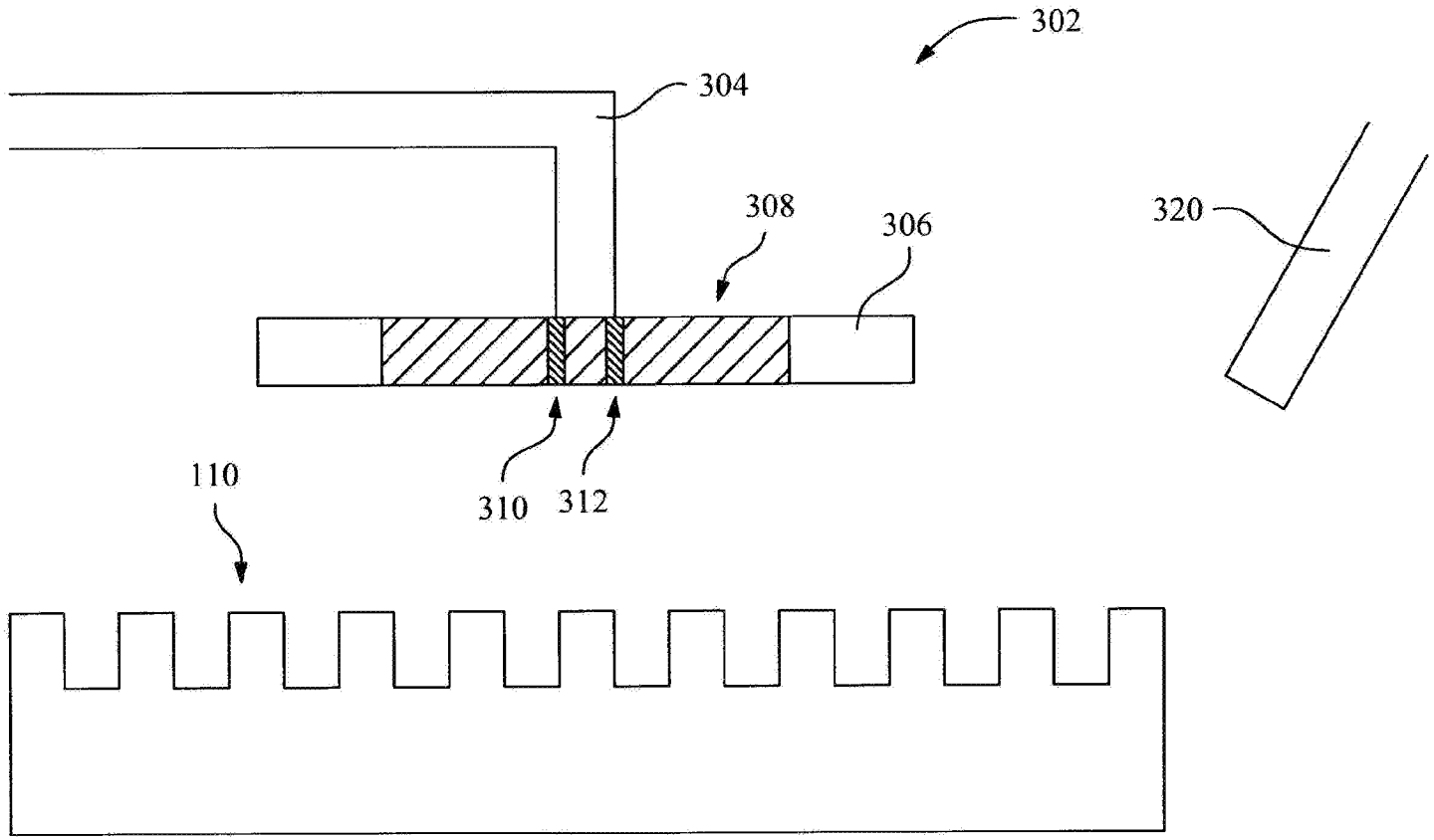
FIG. 3 is a cross-sectional view of a portion of a novel CMP tool, in accordance with some embodiments.

Referring now to FIG. 3, an embodiment of a novel conditioning device 302 is illustrated. The conditioning device 302 may be similar to the conditioning device 102 as illustrated in FIG. 1. The conditioning device 302 may include an arm 304, a dresser head 308 coupled to the arm 304, a polishing disc 306 that is coupled to the dresser head 308 and the arm 304, and a fluid delivery device 320 that is configured to apply slurry onto the polishing pad 110. However, in the illustrated embodiment of FIG. 3, the dresser head 308 of the conditioning device 302 may further include a first sensor 310 and a second sensor 312 that are coupled to each other. In accordance with various embodiments, the first sensor 310 is configured to provide a surface profile (e.g., a topographical image) of the polishing pad 110. In some embodiments, the surface profile, provide by the first sensor 310, may include an optical image, a digitally re-constructed image, an iterative re-constructed image of the polishing pad 110. In general, according to various embodiments, such images may include visionary data with corresponding position data. The second sensor 312 is configured to measure the depth of each of the grooves of the polishing pad 110 and the size of defects/debris associated with the polishing pad. According to various embodiments, the first sensor 310 may include a three-dimensional laser camera, an acoustic wave camera, and/or a scanning electron microscopy (SEM) and the second sensor 312 may include an optical sensor and/or an acoustic wave sensor. In the example in which the first sensor 310 includes a SEM, an image provided by the first sensor may be an SEM image that shows what the surface profile of the polishing pad 110 looks like and includes position data for each groove of the polishing pad 110. In the example in which the second sensor 312 includes an acoustic wave sensor, the second sensor 312 may first generate an ultrasonic/sonic wave to the polishing pad 110, receive another ultrasonic/sonic wave that is reflected from the polishing pad 110, and based on the reception of the reflected wave, measure a depth of a groove and a thickness of any possibly existent debris/defect. In some embodiments, the first sensor 310, the second sensor 312, and the polishing disc 306 are controlled based on a closed-control loop. That is, the polishing disc 306 may apply a corresponding polishing condition that is responsive to the measurements of the first sensor 310 and the second sensor 312. Details of the operations of the dresser head 302 and the coupled polishing disc 306 will be provided in method 400 with respect to FIG. 4.

Figure 4:
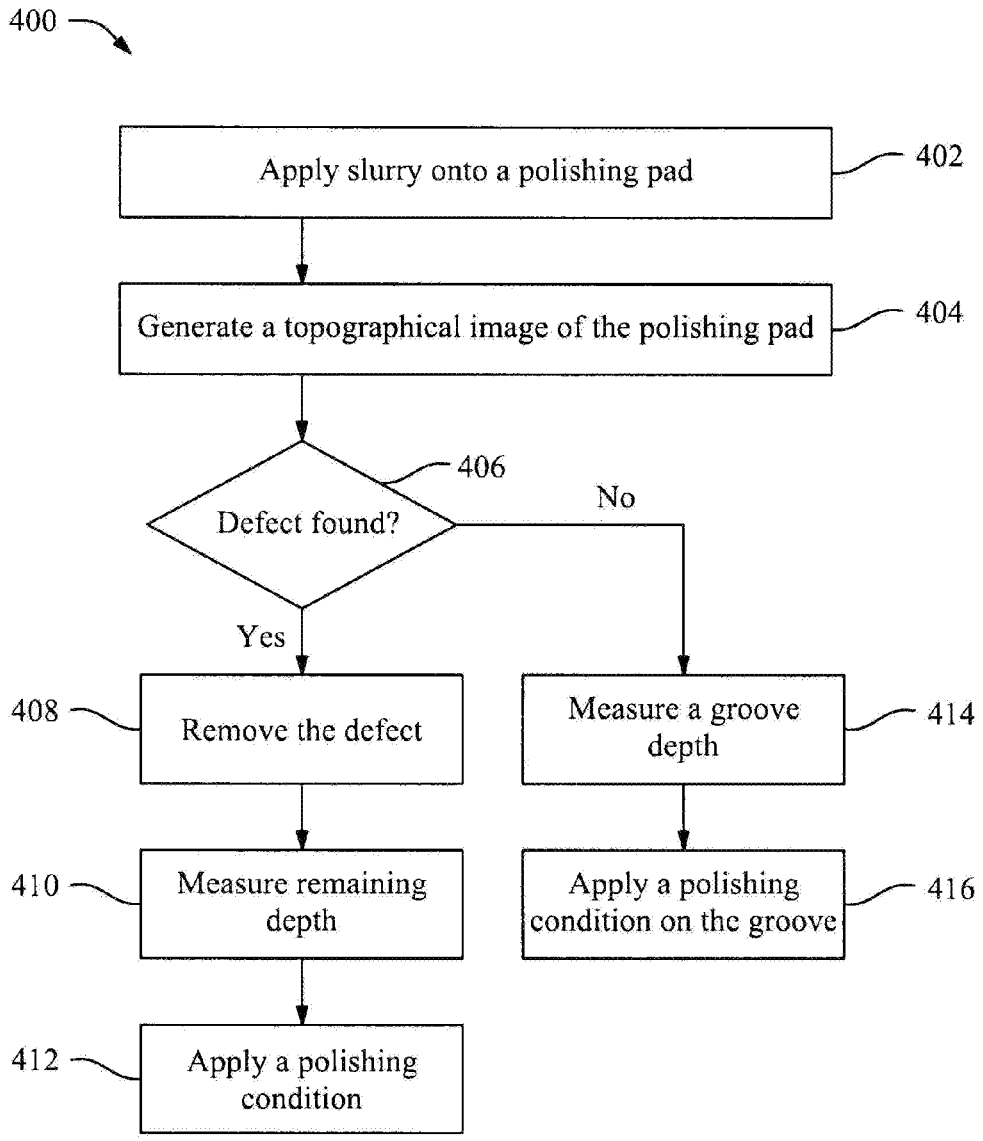
FIG. 4 is a flow chart of a method constructed in accordance with some embodiments.

Referring now to FIG. 4, a flow chart of an embodiment of a method 400 for performing a polish process is illustrated. The method 400 may be implemented, in whole or in part, by a polishing system (e.g., the CMP tool 100), and/or other polishing processes. Additional operations can be provided before, during, and/or after the method 400, and some operations described can be replaced, eliminated, or moved around for additional embodiments of the method. The method 400 will be discussed in conjunction with FIG. 3. The method 400 starts at operation 402 with applying slurry onto the polishing pad 110. The slurry may be distributed over the polishing pad 110 through being contained in the grooves.

The method 400 then proceeds to operation 404 with generating a topographical image of the polishing pad 110 by using the first sensor 210 of the dresser head 308. In the example of implementing the first sensor 210 as a three-dimensional laser camera, a shape and/or an appearance of the polishing pad 110 may be collected by the sensor 210 and then a digitally constructed three-dimensional image and/or model may be provided. Using such topographical images being generated by the first sensor 310, a debris/defect may be more efficiently detected/seen at operation 406 of the method 400.

If at the operation 406, a defect is detected, the method 400 may route to operation 408 in which the polishing disc 306 is used to remove the defect. Referring now to operation 408 of the method 400, in some specific embodiments, once a defect is detected via the first sensor 310, the coupled second sensor 312 may be initiated by a closed-control loop to measure a thickness of the defect. Based on the measurement of the thickness of the defect, the polishing disc 306 may apply a particular downward force on the polishing pad 110 in order to just remove the defect and cause minimal deterioration on the depth of the groove.

In some alternative embodiments, based on the measurement of the thickness of the defect, the polishing disc 306 may apply a particular polishing time on the polishing pad 110 in order to just remove the defect. Yet in some alternative embodiments, based on the measurement of the thickness of the defect, the polishing disc 306 may apply a particular downward force and polishing time on the polishing pad 110 in order to just remove the defect.

Referring still to FIG. 4, after the defect in removed in operation 408, the method 400 continues to operation 410 in which the second sensor 312 measures a remaining depth of the groove that was previously covered/occupied by the removed defect. Based on the measured depth of the remaining groove, a polishing condition is applied to the remaining groove. That is, the polishing condition is selected based on the measured remaining depth of the groove. In some specific embodiments, the polishing condition may include an altered/different downward force applied to the polishing pad 110 and/or an increased/decreased polishing time.

However, if at the operation 406, a defect is not detected, the method 400 may route to operation 414 in which the depth of each groove is measured by the second sensor 312 of the dresser head. The depth of each of the grooves is measured by the second sensor 312 and such measurement of the depth may be used as a basis for the polishing disc 306 to apply a polishing condition on the polishing pad 110 (operation 416). In some specific embodiments, the polishing condition may include a downward force applied to the polishing pad 110 and/or a polishing time. Although in the illustrated embodiment of FIG. 3, the polishing disc 306 is large enough to cover more than one groove on the polishing pad 110, in some alternative embodiments, the polishing disc 306 may be designed as small as to cover only one groove on the polishing pad 110. As such, each of the grooves may be applied, by the polishing disc 306, with an individual polishing condition.

The embodiments of the disclosed systems and methods provide various advantages over the conventional polishing systems. In an embodiment, a method for polishing a polishing pad includes detecting, by a first sensor, a presence of a defect formed on a groove of a polishing pad; removing, by a polishing disc, the defect from the groove of the polishing pad; after removing the defect, measuring, by a second sensor, a remaining depth of the groove; and based on the measured remaining depth of the groove, applying, through the polishing disc, a polishing condition on the groove.

In another embodiment, a method includes generating, by a first sensor of a dresser head, a topographical image of a top surface of a polishing pad, wherein the top surface of the polishing pad includes a plurality of grooves; measuring, by a second sensor of the dresser head that is coupled to the first sensor, a depth of each of the plurality of the grooves; and based on the measurement of the depth of each of the plurality of the grooves, applying, through a polishing disc coupled to the dresser head, a polishing condition on each of the plurality of the grooves.

Yet in another embodiment, an apparatus for a semiconductor process includes a polishing pad that includes a plurality of grooves on a top surface of the polishing pad, wherein each of the plurality of grooves has a thickness; a polishing disc that is located above the polishing disc and is configured to polish the top surface of the polishing pad; and a dresser head that is coupled to the polishing pad and that includes a first sensor that is configured to detect a presence of a defect formed on one of the plurality of the grooves during polishing; and a second sensor that is configured to measure the thickness of each of the plurality of grooves during polishing.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method for polishing a polishing pad, comprising:

detecting, by a first sensor, a presence of a defect formed on a groove of a polishing pad;

removing, by a polishing disc, the defect from the groove of the polishing pad;

after removing the defect, measuring, by a second sensor, a remaining depth of the groove; and based on the measured remaining depth of the groove, applying, through the polishing disc, a polishing condition on the groove.

2. The method of claim 1, wherein detecting the presence of the defect includes forming a topographic image of the top surface of the polishing pad.

3. The method of claim 1, wherein the first sensor includes a device selected from the group consisting of a three-dimensional laser camera, an acoustic wave camera, and a scanning electron microscopy device.

4. The method of claim 1, wherein the second sensor includes a device selected from the group consisting of an optical sensor and an acoustic wave sensor.

5. The method of claim 1, further comprising applying a polishing slurry onto the polishing pad prior to detecting the presence of the defect.

6. The method of claim 1, wherein the polishing pad includes a plurality of grooves, each of the plurality of the grooves having a depth.

7. The method of claim 6, wherein the second sensor is further configured to measure the depth of each of the plurality of the grooves.

8. The method of claim 1, wherein the polishing condition includes a condition selected from the group consisting of a polishing time applied to the polishing pad and downward force applied to the polishing pad.

9. A method comprising:

generating, by a first sensor of a dresser head, a topographical image of a top surface of a polishing pad, wherein the top surface of the polishing pad includes a plurality of grooves;

measuring, by a second sensor of the dresser head that is coupled to the first sensor, a depth of each of the plurality of the grooves; and based on the measurement of the depth of each of the plurality of the grooves, applying, through a polishing disc coupled to the dresser head, a polishing condition on each of the plurality of the grooves.

10. The method of claim 9, wherein generating the topographical image of the top surface of the polishing pad, the measuring the depth of each of the plurality of the grooves, and the applying the individual polishing condition on each of the plurality of the grooves form a closed-loop feedback process.

11. The method of claim 9, wherein generating the topographical image of the top surface of the polishing pad further comprises detecting a presence of a defect formed on one of the plurality of the grooves.

12. The method of claim 11, further comprising removing, by a polishing disc that is coupled to the dresser head, the defect.

13. The method of claim 12, further comprising:

after removing the defect, measuring, by the second sensor of the dresser head, a remaining depth of the groove; and based on the measurement of the remaining depth, applying another polishing condition on the groove.

14. The method of claim 9, wherein the polishing condition includes a condition selected from the group consisting of a polishing time and a downward force applied against the top surface of the polishing pad.

15. The method of claim 9, wherein the first sensor includes a device selected from the group consisting of a three-dimensional laser camera, an acoustic wave camera, and a scanning electron microscopy device.

16. The method of claim 9, wherein the second sensor includes a device selected from the group consisting of an optical sensor and an acoustic wave sensor.

17. The method of claim 9, further comprising applying a polishing slurry onto the top surface of the polishing pad.

18. An apparatus for a semiconductor process, comprising:

a polishing pad that includes a plurality of grooves on a top surface of the polishing pad, wherein each of the plurality of grooves has a thickness;

a polishing disc that is located above the polishing pad and is configured to polish the top surface of the polishing pad; and a dresser head that is coupled to the polishing disc, comprising:

a first sensor that is configured to detect a presence of a defect formed on one of the plurality of the grooves during polishing; and a second sensor that is configured to measure the thickness of each of the plurality of grooves during polishing.

19. The apparatus of claim 18, wherein the first sensor includes a device selected from the group consisting of a three-dimensional laser camera, an acoustic wave camera, and a scanning electron microscopy device.

20. The apparatus of claim 18, wherein the second sensor includes a device selected from the group consisting of an optical sensor and an acoustic wave sensor.

* * * * *